United States Patent [19]

Goodnow

[11] Patent Number: 4,459,176

[45] Date of Patent: Jul. 10, 1984

[54] DEWATERING SYSTEM WITH ADJUSTABLE WIDTH SUCTION SLOTS

[75] Inventor: Ronald F. Goodnow, Leicester, Mass.

[73] Assignee: Thermo Electron Corporation, Waltham, Mass.

[21] Appl. No.: 440,961

[22] Filed: Nov. 12, 1982

[51] Int. Cl.[3] ..... D21F 1/52

[52] U.S. Cl. ..... 162/366; 162/374

[58] Field of Search ..... 162/366, 374, 352

[56] References Cited

U.S. PATENT DOCUMENTS

| | | | |
|---|---|---|---|
| 3,645,844 | 2/1972 | Grenier | 162/352 |
| 3,836,428 | 9/1974 | McConaughy | 162/366 X |
| 3,953,284 | 4/1976 | Evalahti | 162/352 |
| 4,140,573 | 2/1979 | Johnson | 162/352 X |
| 4,278,497 | 7/1981 | Mellen | 162/366 X |
| 4,280,869 | 7/1981 | Eckerdt | 162/366 X |

*Primary Examiner*—Richard V. Fisher

*Attorney, Agent, or Firm*—Thompson, Birch, Gauthier & Samuels

[57] ABSTRACT

A suction dewatering system for a papermaking machine has a suction device with an opening extending longitudinally in a direction transverse to the path of material travel through the machine. Elongated wear strips are supported on opposite sides of the opening to define a suction slot therebetween. A guide channel extends longitudinally through at least one of the wear strips in a direction parallel to the suction slot. An adjusting plate is shiftable longitudinally within the guide channel. Oblique cam slots in the adjusting plate coact with fixed guide members to laterally adjust the position of the one wear strip relative to the other wear strip to thereby vary the width of the suction slot.

9 Claims, 4 Drawing Figures

DEWATERING SYSTEM WITH ADJUSTABLE WIDTH SUCTION SLOTS

BACKGROUND OF THE INVENTION

This invention relates generally to suction dewatering systems for paper making machines wherein the felt is passed over suction slots defined by laterally spaced wear strips. The invention is concerned in particular with an improved arrangement for adjusting the widths of the suction slots by laterally shifting the relative positions of the wear strips.

The known arrangements for laterally shifting the wear strips all suffer from various drawbacks. For example, in the arrangement disclosed in U.S. Pat. No. 3,836,428 (McConaughy) some of the wear strips are provided with centrally located longitudinally extending dovetail slots whereas other wear strips are provided with dovetail slots which are laterally offset. These slots are adapted to slide over upstanding fixed mounting ribs located along the sides of the suction openings. Different suction slot widths can be obtained by arranging the wear strips in different combinations and by turning the wear strips with laterally offset slots end for end. One problem with this arrangement, however, is that a number of different types of wear strips must be kept in inventory. Moreover, the turning of wear strips end for end is awkward and time consuming. Also, there are only a limited number of suction slot widths available with this type of arrangement.

In an attempt at avoiding these problems, arrangements of the type disclosed in U.S. Pat. Nos. 4,278,497 (Mellen) and 4,280,869 (Eckerdt) have been developed.

In both of these arrangements, the wear strips have cam slots which extend obliquely in relation to the suction slot. In the '497 arrangement, the wear strips are movable longitudinally and the oblique cam slots coact with oblique stationary guide rails, whereas in the '869 arrangement the wear strips are longitudinally stationary and the obligue cam slots receive longitudinally movable cam members. In either case, however, the oblique cam slots produce a lateral shifting of the wear strips and a corresponding adjustment in the width of the suction slots. The difficulty with these arrangements, however, is that if the wear strips on opposite sides of a given suction slot are to be adjustable, then they must be machined differently, i.e., with right or left hand oblique cam slots. This again increases inventory costs. Moreover, the oblique cam slots make it difficult if not impossible to longitudinally remove and replace the wear strips without disturbing other components. Thus machine maintenance is made much more difficult, often resulting in protracted and costly down time.

SUMMARY OF THE INVENTION

Ihe present invention has as its basic objective the provision of an improved arrangement for adjusting the widths of suction slots in the dewatering system of a papermaking machine, which is both novel and free of the above-noted problems associated with previously developed arrangements. Instead of machining the wear strips with laterally offset or oblique slots as taught by the prior art, the wear strips of the present invention all have the same design, with centrally located longitudinally extending guide channels. Cam-type adjusting and locking assemblies operate within the guide channels to effect lateral adjustment of the wear strips, and to releasably fix the wear strips at their adjusted positions.

Worn wear strips may be longitudinally removed from their respective adjusting and locking assemblies in directions parallel to the suction slots, and fresh wear strips may be reinserted in the same direction, all without disturbing other machine components. Moreover, since all of the wear strips are identical, inventory costs are reduced significantly.

These and other objects, features and advantages of the present invention will now be described in more detail with reference to the accompanying drawings, wherein:

DETAILED DESCRIPTION

Figure 1:
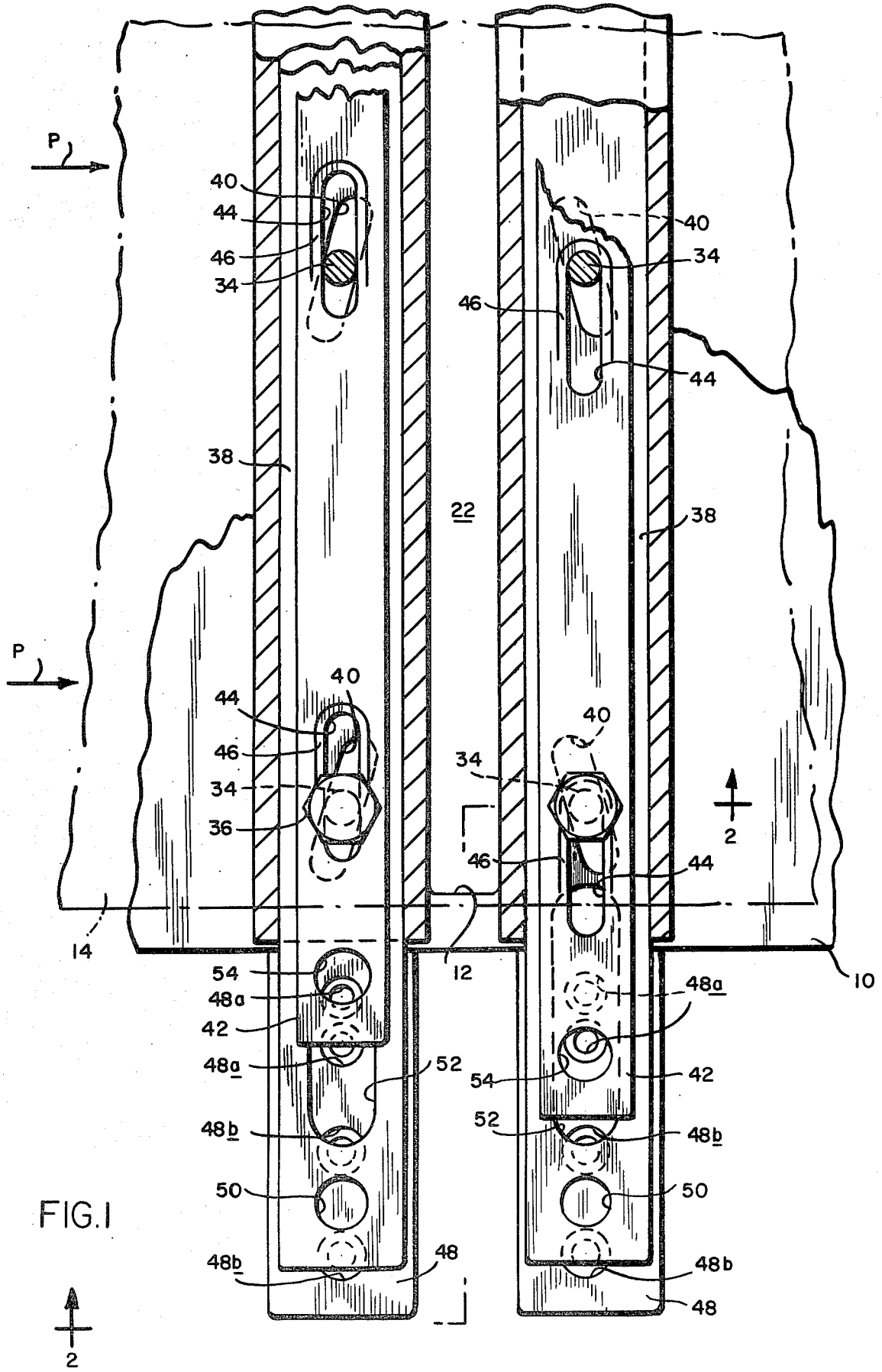
FIG. 1 is a partial plan view, with portions broken away, showing a suction dewatering system embodying the concepts of the present invention.

A suction device in the form of a pipe 10 has a longitudinal opening 12 extending transversally with respect to the path of travel "P" of an overlying felt 14. The pipe 10 is adapted for connection in a conventional well known manner to a source of suction (not shown). Stationary elongated lands 16 extend along opposite side of the opening 12. The lands provide mounting surfaces 18.

Identical elongated wear strips **20*a*, 20*b* are adapted to te supported on the mounting surfaces 18. The wear strips are spaced one from the other to define an elongated suction slot 22 which overlies and is in alignment with the pipe opening 12. The wear strips can be formed from ceramic or plastic materials, with their upper surfaces 24*a*, 24*b* being arranged to support the felt 14** as it moves along the papermaking machine. The ends of the suction slot may be blocked by deckles or other like conventional closure elements (not shown).

Each wear strip is provided with a channel 26 facing downwardly towards its respective mounting surface 18. The channels have interior ledges 28 formed by inwardly protruding shoulders 30.

Figure 2:
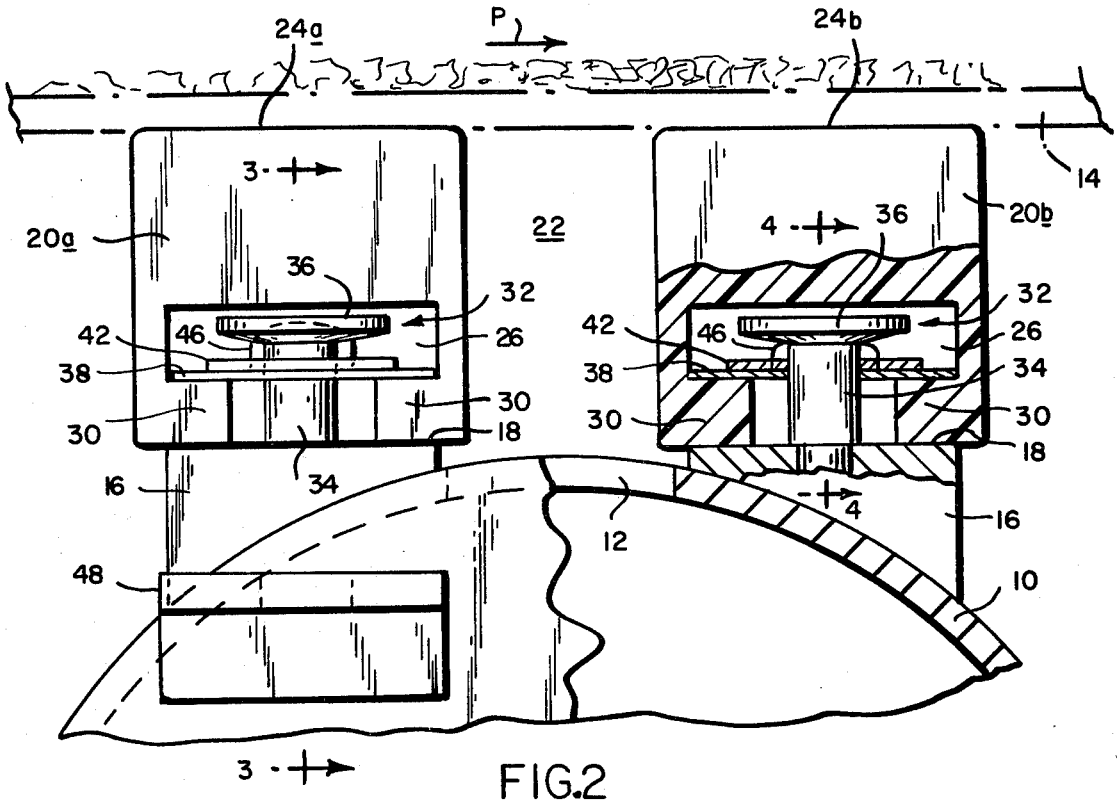
FIG. 2 is an end and partial cross-sectional view taken along line 2—2 of FIG. 1.

Adjusting and locking assemblies generally indicated in FIG. 2 at 32 are located within the channels 26. Each assembly 32 includes a plurality of guide members 34 spaced along the lands 16 and protruding upwardly from the mounting surfaces 18 between the interior channel shoulders 30. The guide members may conveniently comprise shoulder screws with enlarged heads 36.

Elongated adjusting plates 38 extend through the channels 26. The adjusting plates are supported on the ledges 28 and are provided with cam slots 40 which extend obliquely with respect to the length of the suction slot 22. The adjusting plates 38 are confined against lateral movement in relation to their respective wear strips by the side walls of the channels 26.

Locking plates 42 lie on the adjusting plates. The locking plates have elongated locking slots 44 which are parallel to the suction slot 22 and to the lengths of the channels 26, and which are at least partially in registration with the underlying cam slots 40. The locking slots are at least partially bounded by upwardly inclined resilient locking ears 46 which are stamped or otherwise integrally formed from the locking plate material. The guide members protrude through both the cam slots 40 and the locking slots 46, with their heads 36 being located proximately to the locking ears 46.

The adjusting plates 38 and the locking plates 42 have ends which protrude beyond the ends of the wear strips to overlie brackets 48 fixed to the end of the suction pipe 10. The brackets 48 are provided with a set of locking holes 48*a* and a set of adjusting holes 48*b*. The protruding end of eact adjusting plate 38 has an adjusting hole 50 and an elongated access slot 52. The protruding end of each locking plate 42 has a locking hole 54.

Figure 3:
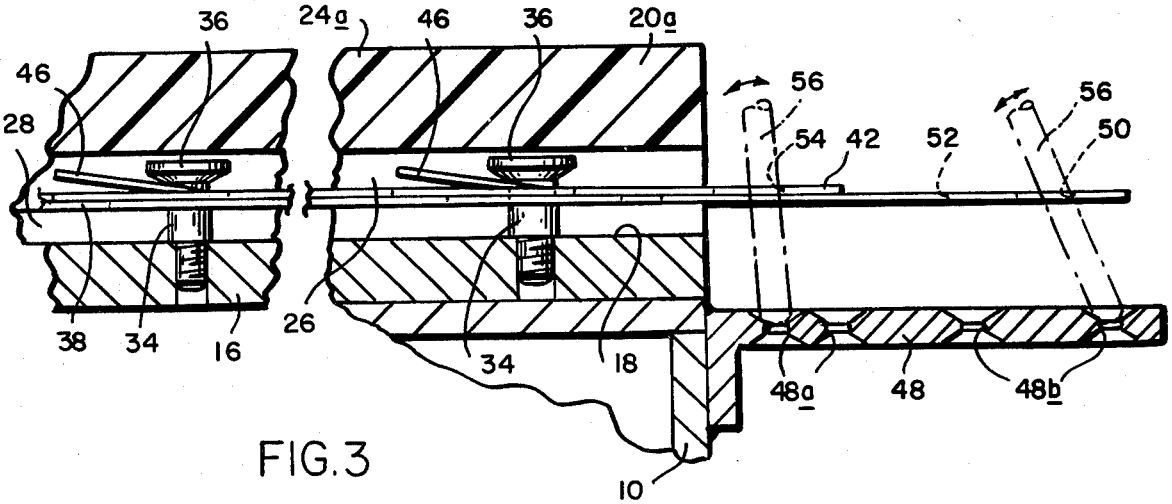
FIGS. 3 and 4 are sectional views taken respectively on lines 3—3 and 4—4 of FIG. 2.
Figure 4:
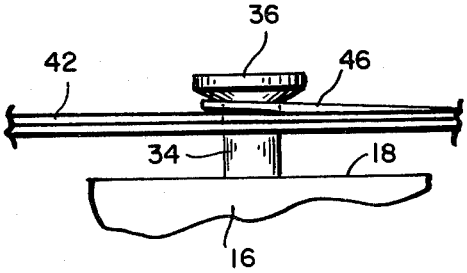

Each locking plate 42 is shiftable longitudinally between a "clamp" position as shown in FIG. 4 and the right-hand side of FIG. 1, and a "release" position as shown in FIG. 3 and the left-hand side of FIG. 1. When in the clamp position, the locking plate has been shifted to the right as viewed in FIG. 4, thereby pulling the locking ears 46 beneath the enlarged heads 36 of the guide members 34. The locking ears coact resiliently with the heads 36 to produce a downward force which acts through the underlying adjusting plate 38 and its supporting ledges 30 to clamp the wear strip in a fixed position on its mounting surface. When the locking plate is shifted in the opposite direction to the release position, the locking ears 46 are moved out from under the heads 36 as shown in FIG. 3 to relieve the downward clamping force sufficiently so as to permit relative movement between the wear strip and its mounting surface, as well as relative movement between the adjusting plate and both the wear strip and the locking plate.

With the locking plate 42 in its release position, the adjusting plate 38 can be shifted longitudinally in either direction within the channel 26. As this occurs, the guide members 34 coact with the oblique cam slots 40 to laterally shift the adjusting plate and the wear strip, thereby changing the width of the suction slot 22. Once the proper adjustment is achieved, the locking plate is returned to its clamp position to fix all components in place.

The shifting of the locking plate 42 can be accomplished manually by first inserting a tool 56 (see FIG. 3) through the locking hole 54 and the access slot 52 in the underlying adjustment plate and into one of the locking holes 48*a* in the bracket 48, and then simply rocking the tool in the appropriate direction. The adjusting plate 38 can be shifted in the same way by inserting the tool through the adjusting hole 50 into one of the underlying holes 48*b* in clamp 48.

In light of the foregoing, it will now be appreciated by those skilled in the art that the present invention offers a number of important advantages over known prior art arrangements. For example, because the wear strips are identical, they can be interchanged one for the other at any location along the machine. The longitudinal channels 26 make it possible to withdraw worn wear strips from their respective mounting surfaces while allowing the adjusting and locking assemblies 32 to remain in place, and to thereafter insert new wear strips, again without having to dismantle the assemblies 32. The wear strips may be withdrawn and replaced by moving them longitudinally in directions parallel to the suction slots and adjacent wear strips, thus further facilitating maintenance procedures.

It is to be understood that changes and modifications can be made to the embodiment herein decribed and illustrated without departing from the spirit and scope of the invention. For example, the design of the wear strips and the materials from which they are fabricated can be varied to suit particular machine and process requirements. Other means, either manually operable or automatically controlled, may be employed to shift the adjusting and locking plates. Also, under certain circumstances, it may be desirable to laterally adjust only one of the wear strips, and to allow the other wear strip to remain in a fixed position.

I claim:

1. In a papermaking machine, a suction dewatering system, comprising:

means defining an opening adjacent to the path of material travel through the machine, said opening being adapted for connection to a source of suction;

elongated wear strips supported on opposite sides of said opening to define a suction slot therebetween which is aligned with said opening;

a channel extending longitudinally through at least one of said wear strips in a direction parallel to said suction slot;

adjustment means movable longitudinally within said channel for laterally adjusting the position of the said one wear strip relative to the other wear strip in order to vary tbe width of said suction slot, said adjustment means including a first elongated element having cam slots therein which extend obliquely in relation to said suction slot, with fixed guide members protruding into said cam slots; and locking means for releasably fixing said one wear strip in relation to the other wear strip, said locking means comprising a second elongated element movable longitudinally within said channel and having associated therewith means for resiliently coacting with said fixed guide members.

2. The system of claim 1 wherein said elements comprise superimposed plates.

3. The system according to either of claims 1 or 2 wherein the said one wear strip is longitudinally separable from the adjustment means in said channel.

4. A suction dewatering system for a papermaking machine, comprising:

a suction device adapted to be connected to a source of suction and having longitudinal opening therein extending in a direction transverse to the travel of material through the machine;

stationary mounting surfaces located on opposite sides of said opening;

elongated wear strips adapted to be supported on said mounting surfaces at locations defining a suction slot therebetween, said suction slot being aligned with said opening, and at least one of said wear strips having a channel extending longitudinally therealong in parallel relationship with said suction slot;

guide members fixed relative to the mounting surface on which the said one wear strip is supported, said guide members being arranged to protrude into said channel;

an elongated first plate laterally confined within said channel and movable longitudinally in relation to said one wear strip, said first plate being supported on interior shoulders in said channel at a location above the mounting surface supporting said one wear strip, said first plate having cam slots therein which extend obliquely with respect to said suction slot, the said guide members being engageable with said cam slots, whereupon longitudinal movement of said first plate within said channel will be accompanied by lateral movement of said one wear strip relative to the other wear strip as a result of the engagement of said guide members with said cam slots;

means for imparting longitudinal movement to said first plate; and locking means for releasably forcing said first plate downwardly against said shoulders to thereby clamp the said one wear strip downwardly onto its respective mounting surface.

5. The system of claim 4 wherein said locking means comprises an elongated second plate supported within said channel on said first plate, said second plate having locking slots therein with resilient locking ears adjacent thereto, said guide members protruding through said locking slots, said second plate being movable longitudinally relative to said first plate between a "clamp" position at which said locking ears resiliently coact with said guide members to exert a downward force on said first plate to thereby fixedly clamp said one wear strip onto its mounting surface, and a "release" position at which said downward force is sufficiently relieved to allow movement of said one wear strip relative to its mounting surface.

6. A suction dewatering system for a papermaking machine, comprising:

a suction device adapted to be connected to a source of suction and having an opening therein located adjacent to the path of material travel through the machine;

first and second mounting surfaces located at fixed positions on opposite sides of said opening;

elongated first and second wear strips adapted to be supported respectively on said first and second mounting surfaces at locations defining therebetween a suction slot which is in registry with said opening, at least the first of said wear strips having a channel therein facing downwardly towards the said first mounting surface, said channel extending longitudinally along the entire length of said first wear strip in parallel relationship with said suction slot;

ledges spaced vertically above said first mounting surfaces and extending interiorly along opposite sides of said channel;

upper and lower superimposed elongated plates carried within said channel on said ledges, said lower plate being confined against lateral movement within said channel and having cam slots therein which extend obliquely in relation to said suction slot, said upper plate having locking slots therein which extend in parallel relationship with said suction slot and which are in at least partial registration with said cam slots, said upper plate being further provided with integral resilient protrusions adjacent to said locking slots;

fixed guide members protruding upwardly from said first mounting surface into said channel between said ledges, said fixed guide members extending through said cam slots and said locking slots and terminating in enlarged heads located proximately to said resilient protrusions;

means for moving said upper plate longitudinally within said channel in relation to said lower plate as well as said first wear strip and said guide members between a "clamp" position at which said enlarged heads resiliently coact with said protrusions to produce a downward force preventing relative motion between said second plate and said first wear strip as well as relative motion between said first wear strip and said first mounting surface, and a "release" position at which said downward force is relieved and said relative motions are permitted; and means for moving said lower plate longitudinally within said channel in relation to said upper plate as well as said first wear strip and said guide members, whereupon said guide members cooperate with said cam slots to shift said lower plate and said first wear strip laterally with respect to said second wear strip, thereby varying the width of the suction slot defined therebetween.

7. The system of claim 6 wherein said first wear strip is longitudinally separable from the assembled combination of said first mounting surface, said guide members and said superimposed upper and lower plates.

8. The system of claims 6 or 7 wherein said first and second wear strips are identically constructed and interchangeable one for the other.

9. The system of claim 8 wherein both wear strips are laterally adjustable.

* * * * *